US009896844B2

(12) United States Patent
Cossette et al.

(10) Patent No.: US 9,896,844 B2
(45) Date of Patent: Feb. 20, 2018

(54) I-JOISTS AND METHOD OF FABRICATION THEREOF

(71) Applicant: LES CHANTIERS DE CHIBOUGAMAU LTÉE, CHIBOUGAMAU (CA)

(72) Inventors: Denis Cossette, Chibougamau (CA); Julie Frappier, Chambly (CA); Michel Filion, Chibougamau (CA)

(73) Assignee: LES CHANTIERS DE CHIBOUGAMAU LTÉE, Chibougamau (CA)

( * ) Notice: Subject to any disclaimer, the term of this patent is extended or adjusted under 35 U.S.C. 154(b) by 0 days.

(21) Appl. No.: 15/210,254

(22) Filed: Jul. 14, 2016

(65) Prior Publication Data

US 2017/0016229 A1 Jan. 19, 2017

Related U.S. Application Data

(60) Provisional application No. 62/193,329, filed on Jul. 16, 2015.

(51) Int. Cl.

| | |
|---|---|
| ***E04C 3/16*** | (2006.01) |
| ***E04C 3/292*** | (2006.01) |
| *E04C 3/12* | (2006.01) |

(52) U.S. Cl.

CPC ..... *E04C 3/16* (2013.01); *E04C 3/292* (2013.01); *E04C 3/122* (2013.01)

(58) Field of Classification Search

CPC ..... E04C 3/16; E04C 3/08; E04C 2003/0491; E04C 3/02; E04C 3/04; E04C 3/122; E04C 3/125; E04C 3/29; E04C 3/292; E04C 2003/0452

USPC ..... 52/481.1

See application file for complete search history.

(56) References Cited

U.S. PATENT DOCUMENTS

| | | | | | |
|---|---|---|---|---|---|
| 1,644,940 | A * | 10/1927 | Moyer | E04C 3/086 | 29/425 |
| 1,676,258 | A * | 7/1928 | Fork | E04C 3/086 | 29/897.31 |
| 1,790,495 | A * | 1/1931 | Bates | E04C 3/083 | 52/635 |
| 3,263,387 | A * | 8/1966 | Simpson | E04C 3/083 | 52/634 |

(Continued)

FOREIGN PATENT DOCUMENTS

| | | |
|---|---|---|
| CA | 2654720 | 12/2009 |
| CA | 2663093 | 6/2010 |
| WO | 2000015922 | 3/2000 |

OTHER PUBLICATIONS

Georgia-Pacific GP, Engineered Lumber xj85™ Wood I Beam™ Joist, Installation Guide, 2007, pp. 1-8.

(Continued)

*Primary Examiner* — Beth A Stephan

(74) *Attorney, Agent, or Firm* — Gwendoline Bruneau

(57) ABSTRACT

An I-joist comprising a web and flanges, the web being connected on each longitudinal edge thereof to a flange, wherein the I-joist further comprises chords, the chords being connected to the web on at least one side of the web. The web may comprise openings in between the chords. The I-joist is fabricated by connecting a flange on each longitudinal edge of a web and connecting chords on at least one side of the web, the web being provided with openings.

8 Claims, 7 Drawing Sheets

(56) References Cited

U.S. PATENT DOCUMENTS

| | | | | | |
|---|---|---|---|---|---|
| 3,651,612 | A * | 3/1972 | Schmitt | E04C 3/16 | 52/642 |
| 3,736,716 | A * | 6/1973 | Nishimura | E04B 5/29 | 52/334 |
| 4,336,678 | A * | 6/1982 | Peters | B27M 3/0086 | 403/265 |
| 5,560,177 | A * | 10/1996 | Brightwell | E04C 3/16 | 52/690 |
| 5,664,393 | A * | 9/1997 | Veilleux | E04C 3/16 | 52/650.1 |
| 5,761,872 | A * | 6/1998 | Sanford | E04C 3/16 | 52/694 |
| 6,158,189 | A * | 12/2000 | Lau | E04B 5/12 | 52/690 |
| 6,715,257 | B2 * | 4/2004 | Kent | E04C 3/16 | 254/104 |
| 7,356,974 | B2 * | 4/2008 | Tadich | E04C 3/292 | 52/690 |
| 8,122,676 | B2 | 2/2012 | Lemyre | | |
| 8,166,724 | B2 | 5/2012 | Lemyre | | |
| 2007/0272342 | A1 * | 11/2007 | Holmes | B21D 47/01 | 156/73.5 |
| 2008/0134619 | A1 * | 6/2008 | Nichols | E04B 5/48 | 52/690 |

OTHER PUBLICATIONS

Georgia-Pacific GP, xj85™ Floor Details, 2007, pp. 1-9.
www.openjoisttriforce.com/open-joist-triforce/characteristics/—
May 2, 2017.

* cited by examiner

I-JOISTS AND METHOD OF FABRICATION THEREOF

CROSS REFERENCE TO RELATED APPLICATIONS

This application claims benefit of U.S. provisional application Ser. No. 62/193,329, filed on Jul. 16, 2015. All documents above are incorporated herein in their entirety by reference.

FIELD OF THE INVENTION

The present invention relates to engineered wood. More specifically, the present invention is concerned with I-joists and methods of fabrication thereof.

BACKGROUND OF THE INVENTION

In the field of engineered wood, open web joists are structural trusses generally comprising parallel chords and a triangulated web. Open web joists as known in the art may have a sawn lumber web (not shown), glued-laminated timber (glulam) web (see FIG. 1), or a metallic web (see FIG. 2), metallic connectors (see FIG. 3), or combination thereof (not shown).

I-joists are manufactured structural building components resembling the letter "I", generally used as floor joists and rafters for example.

As shown for example in FIGS. 4A, 4B and 4C, an I-joist 10 includes flanges 12 on each side of a web 14. The flanges 12 may be made of laminated veneer lumber or sawn lumber, with a width in range comprised between 1½" to 3½". The web or center 14 of the I-joist 10 is commonly made of plywood or oriented strand board (OSB).

As illustrated in FIG. 4C, such I-joists can be manufactured with a range of height of the web 14 between the flanges 12 and with a range of width for the web 14. They may also have a variety of grade for the flange. The web 14 is joined on each longitudinal edge thereof to a flange 12 by a joint 16 as best seen in FIG. 4B. The edge 17 of the web 14 is glued in a groove of the flanges 12.

There is still a need in the art for I-joists and methods of fabrication thereof.

SUMMARY OF THE INVENTION

More specifically, in accordance with the present invention, there is provided an I-joist comprising a web and flanges, the web being connected on each longitudinal edge thereof to a flange, wherein the I-joist further comprises chords, the chords being connected to the web on at least one side of the web.

There is further provided a method for fabricating a I-joist, comprising connecting a flange on each longitudinal edge of a web and connecting chords on at least one side of the web.

There is further provided a method for fabricating an open web I-joist, comprising providing a web; cutting out portions of the web; connecting a flange on each longitudinal edge of the web; and connecting chords on at least one side of the web.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

A method according to an embodiment of an aspect of the invention comprises manufacturing an I joist, cutting the web thereof corresponding to a target open web, and securing chords 22*a*, 22*b* for reinforcement. These last two steps may be inverted.

Figure 1:
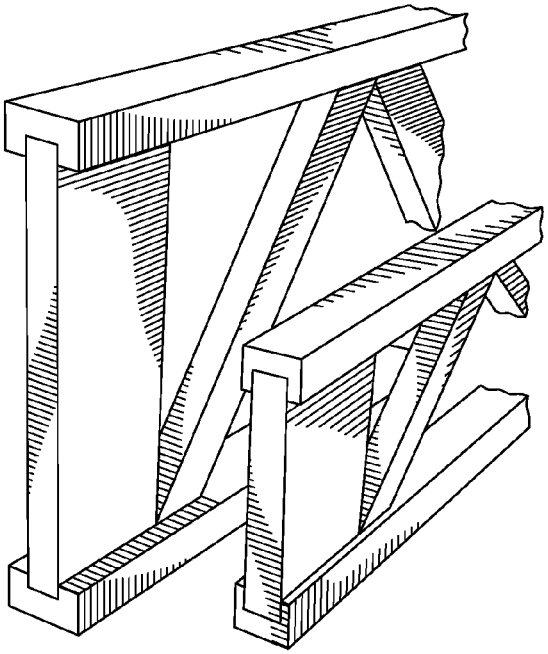
FIG. 1 PRIOR ART
FIG. 1 shows an open web joist with a glulam web as known in the art.
Figure 2:
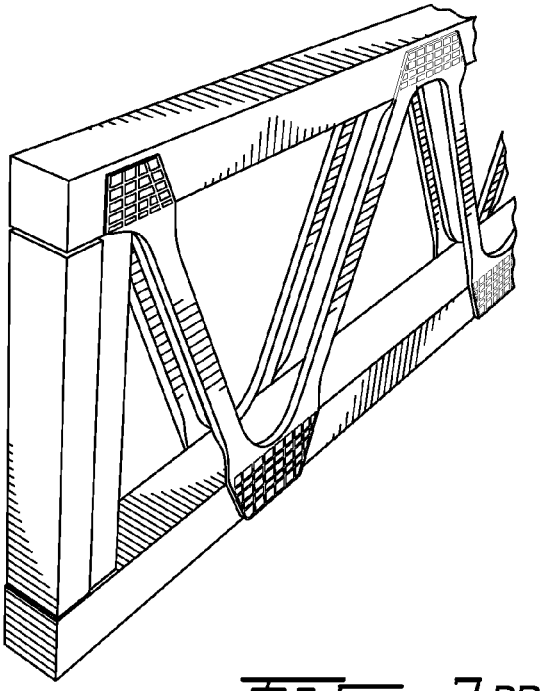
FIG. 2 PRIOR ART
FIG. 2 shows an open web joist with a metal web as known in the art.
Figure 3:
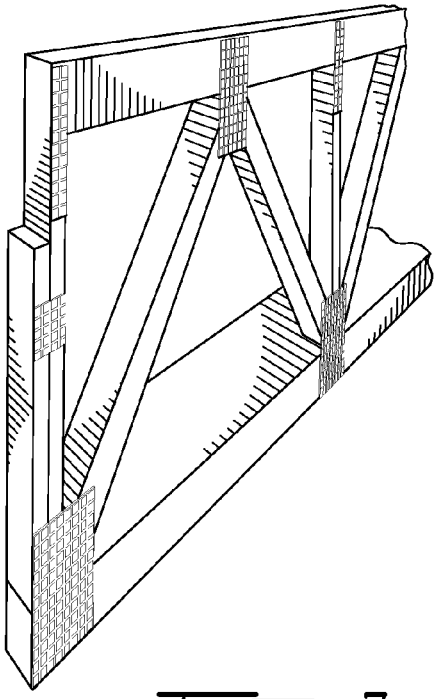
FIG. 3 PRIOR ART
FIG. 3 shows an open web joist with metallic connectors as known in the art.
Figure 4A:
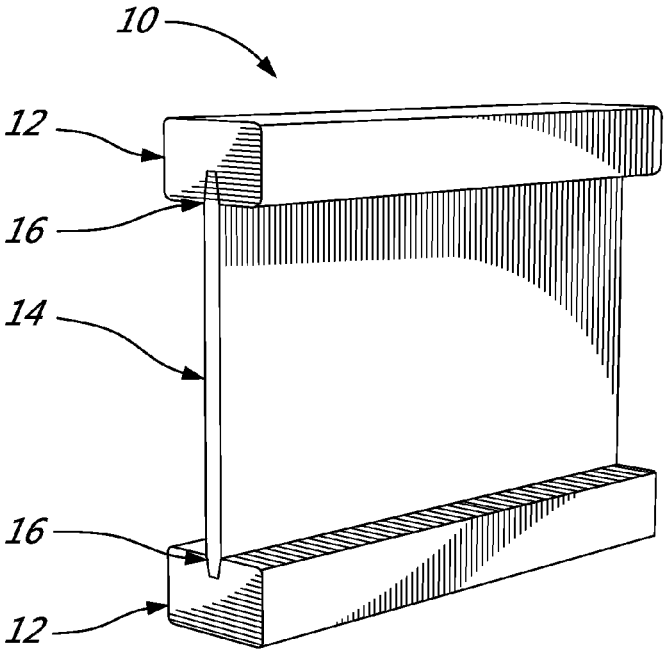
FIG. 4A PRIOR ART
FIG. 4A is a perspective view of a I-joist as known in the art.
Figure 4B:
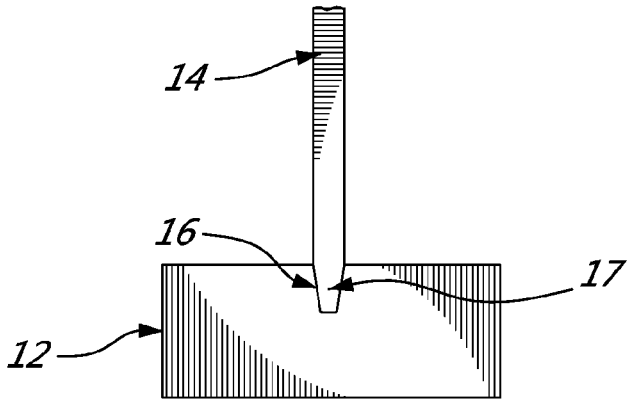
FIG. 4B PRIOR ART
FIG. 4B is a detail of FIG. 4A.
Figure 4C:
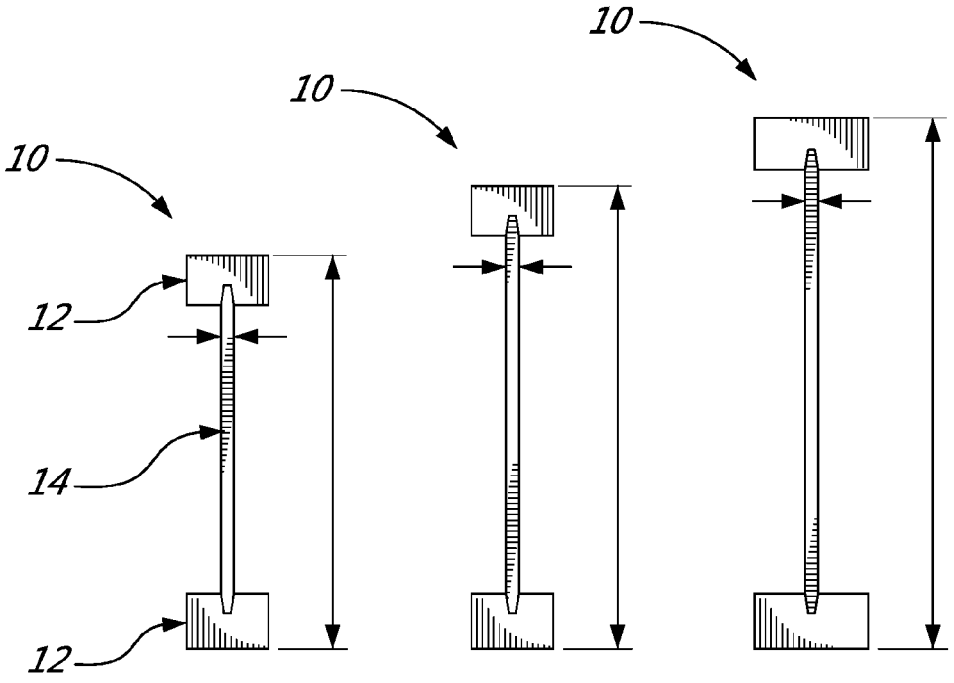
FIG. 4C PRIOR ART
FIG. 4C shows side view of different I-joists.

In the first step, an I-joist as described in relation to FIG. 4A for example is manufactured. The flanges may be in wood for example, such as laminated veneer lumber or sawn lumber, or in a metal such as steel for example. The web may be in oriented strand board (OSB), plywood, sawn lumber or glued-laminated timber (glulam), or in a metal such as steel for example.

Then, the web of the I-joist is cut out, using a router for example, following a predetermined pattern. As best seen in FIG. 5B, portions 20, 24 of the web are saved at positions (20), (24) for supporting the chords 22*a*,22*b*.

Chords 22*a*, 22*b* are connected either on one side of the web parts 20 preserved in between the parallel flanges 12, or on both sides thereof. The chords maybe in wood, for example in sawn lumber or glued-laminated timber (glulam), or in a metal such as steel for example. The flanges 12, chords 22*a*,22*b* and the web are in a wood material for example, the flanges 12 and the chords 22*a*, 22*b* may connected together by the web portions 24 preserved at the corners as just described hereinabove, best seen in FIG. 5B, all glued together using structural glue. In case of metal parts, welding can be used.

Openings may be provided in the web prior to connecting to web to the flanges.

Figure 5A:
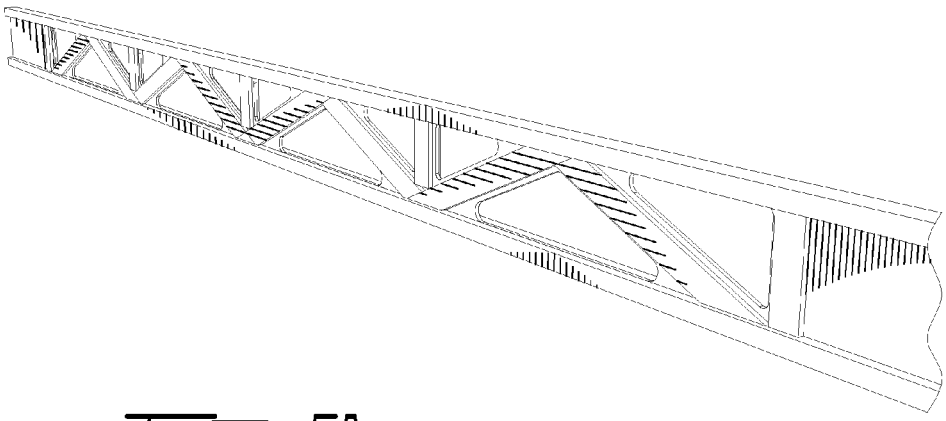
FIG. 5A is a perspective view of an open web I-joist according to an embodiment of an aspect of the present invention.
Figure 5B:
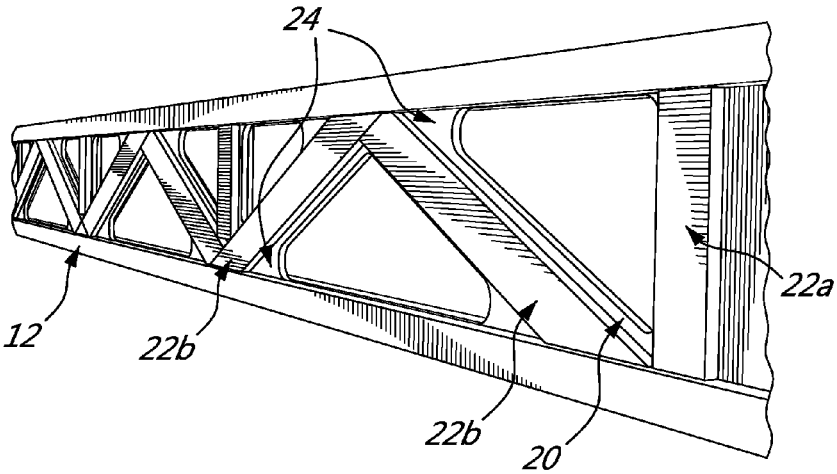
FIG. 5B is a detail of FIG. 5A.
Figure 6A:
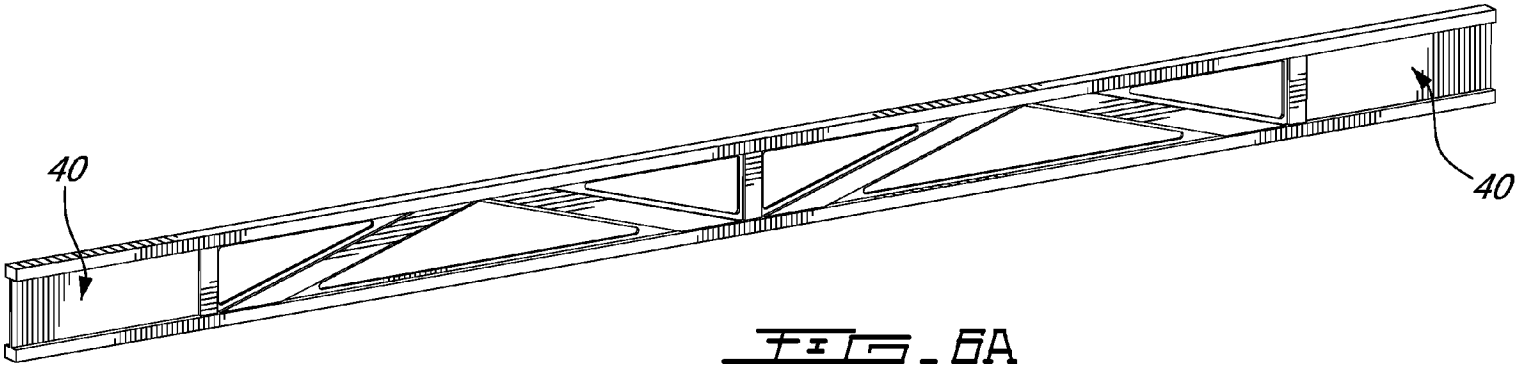
FIG. 6A shows a perspective view of a I-joist according to an embodiment of an aspect of the present invention.
Figure 6B:
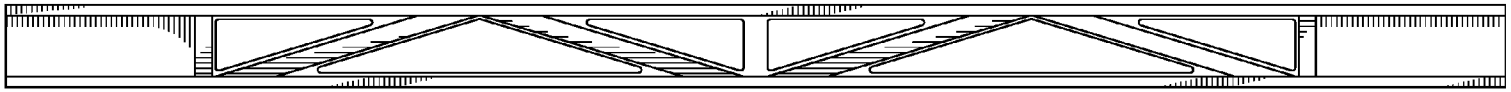
FIG. 6B is a front view of the I-joist of FIG. 6A.
Figure 7:
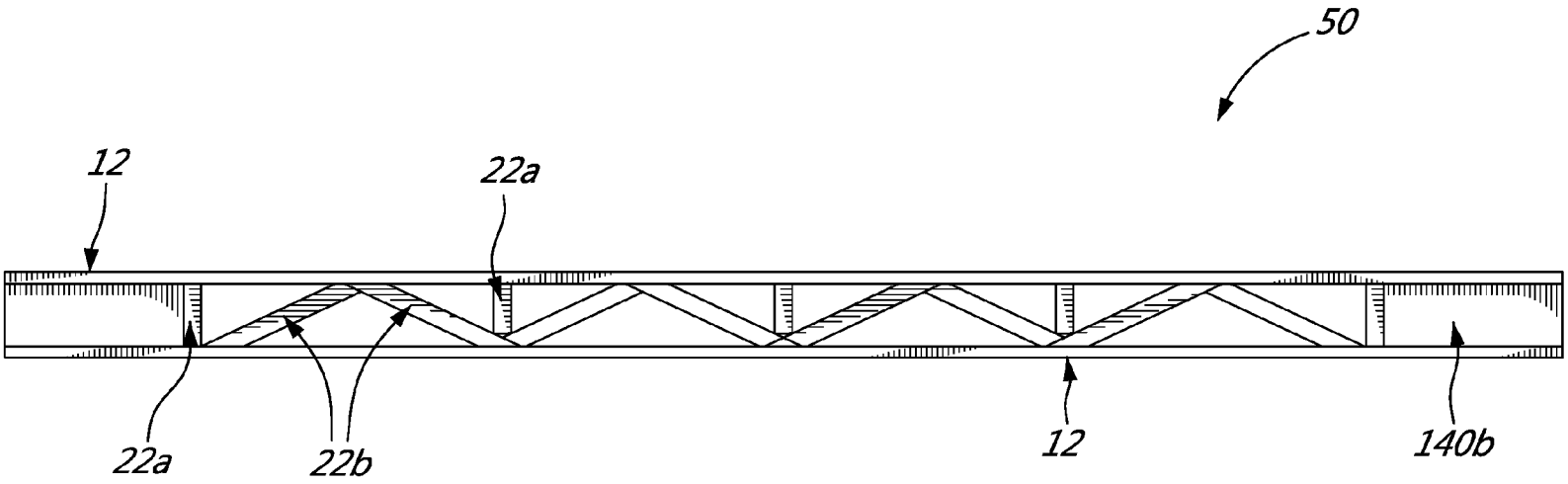
FIG. 7 is a schematical view of an open web I-joist according to an embodiment of an aspect of the present invention.
Figure 8:
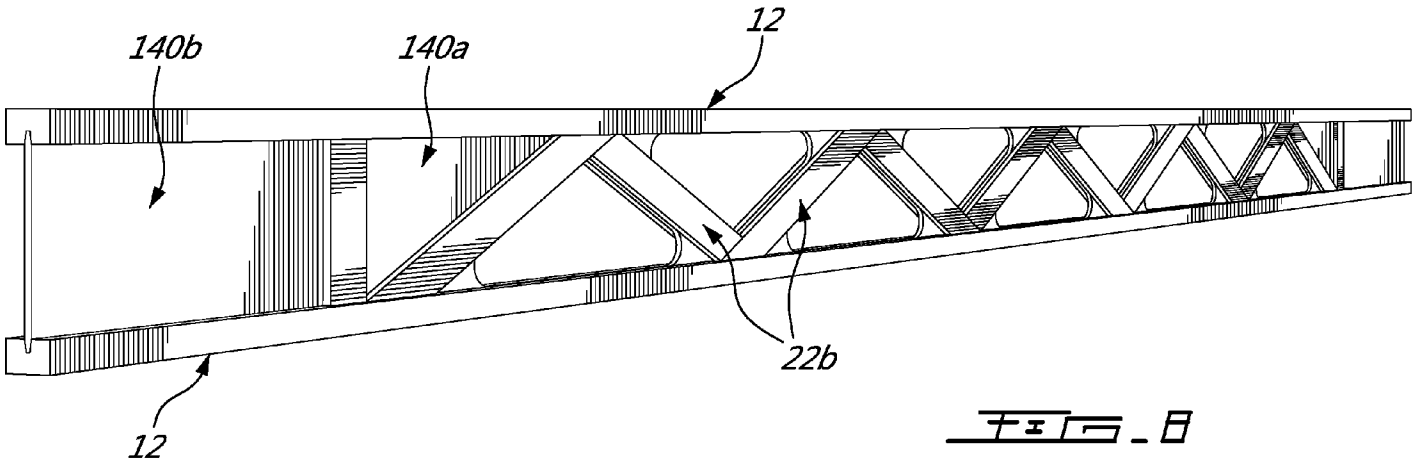
FIG. 8 is a schematical view of an open web I-joist according to an embodiment of an aspect of the present invention.
Figure 9:
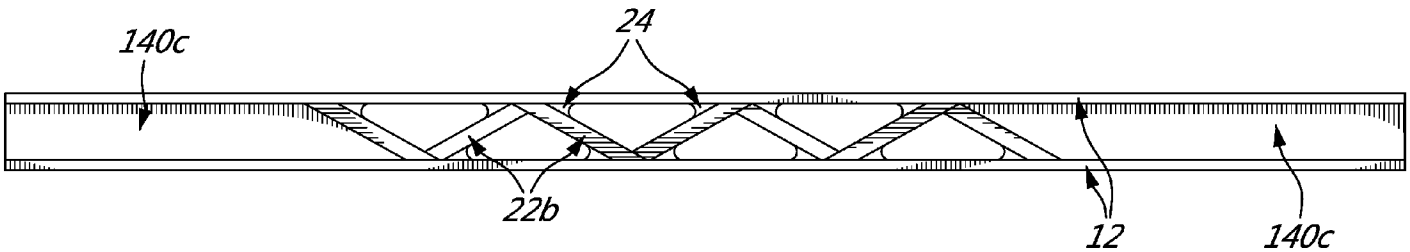
FIG. 9 is a schematical view of an open web I-joist according to an embodiment of an aspect of the present invention.

In the embodiments illustrated in FIGS. 5 to 7, the chords 22*a*, 22*b* include diagonal chords 22*b* and chords 22*a* perpendicular to the flanges 12. In the embodiment illustrated in FIGS. 8 and 9, only diagonal chords 22*b* are used over a length of the I-joist; moreover, the web is saved at some parts of the I-joist, such as end parts 140*a*, 140*b*, 140*c*, while the rest of the web between the chords is open. The web may also be saved at central parts (not shown).

The present invention provides fabricating an open web joist having a patterned web as desired.

The open web joist may have trimmable ends 40, for size adjustment. The open web joist may have a web with openings of a predetermined shape allowing vent tubing to run therethrough for example.

The present method thus allows providing an open web wood joist comprising openings at various target locations between the flanges, while allowing structural properties comparable to those of I-joist.

The present open web joist comprises flanges, in wood for example, and chords, in wood for example, in a unique structural combination. The present open web joist does not require finger joints or metal connectors between the flanges and the chords, as web parts connect the flanges and the chords together. It allows for the passage of electrical wiring, plumbing and duckwork.

A method according to an embodiment of another aspect of the invention comprises manufacturing an I-joist and securing chords 22*a*, 22*b* for reinforcement, thereby forming an hybrid I-joist 50 as illustrated for example in FIG. 7.

The chords 22*a*, 22*b* may be glued to the web 14 using a structural adhesive.

The I-joist 50 comprises flanges, in wood such as laminated veneer lumber or sawn lumber for example, or metal such as steel for example, a web in wood such as oriented strand board (OSB), plywood, sawn lumber or glued-laminated timber (glulam) for example, or metal such as steel for example, and chords, in wood such as glued-laminated timber (glulam) or sawn lumber for example, or in a metal such as steel for example, in a unique structural combination.

Such hybrid I-joist 50 has structural properties comparable to those of open web joists known in the art. It allows for the passage of electrical wiring, plumbing and duckwork by drilling and cutting the web.

The hybrid I-joist may be used as replacement of known I-joist, open web joist, solid sawn lumber, structural composite lumber or glued-laminated timber.

The scope of the claims should not be limited by the embodiments set forth in the examples, but should be given the broadest interpretation consistent with the description as a whole.

The invention claimed is:

1. An I-joist, comprising flanges and chords, said flanges connected together at a distance by web portions, said chords being connected to said web portions on at least one side of the web portions, said flanges and said chords being connected together by said web portions, the distance between said flanges being generally open between said web portions and said chords, said web portions, said flanges and said chords being in wood, said chords comprising at least one diagonal chord.

2. The I-joist of claim 1, wherein said chords comprise at least one chord perpendicular to the flanges.

3. A method for fabricating a I-joist, comprising:

connecting a flange on each longitudinal edge of a web;

then cutting out the web to preserve web portions around openings in between the flanges; and connecting chords on at least one side of the web portions, whereby the flanges and the chords are connected together by the web portions.

4. The method of claim 3, wherein said connecting chords comprises connecting at least one of: diagonal chords and chords perpendicular to the flanges.

5. The method of claim 3, wherein said connecting chords comprises connecting diagonal chords along at least a first length of the web.

6. A method for fabricating an open web I-joist, comprising:

providing a web;

cutting out the web to preserve web portions around openings, thereby forming an open web;

connecting a flange on each longitudinal edge of the open web; and connecting chords on at least one side of the open web portions, whereby the flanges and the chords are connected together by the web portions.

7. The method of claim 6, wherein said connecting chords comprises connecting at least one of: diagonal chords and chords perpendicular to the flanges.

8. The method of claim 6, wherein said connecting chords comprises connecting diagonal chords along at least a first length of the web.

* * * * *